US006533138B2

(12) United States Patent
Chwen-Ru

(10) Patent No.: US 6,533,138 B2
(45) Date of Patent: Mar. 18, 2003

(54) FOLDABLE TOOL KIT

(76) Inventor: Lin Chwen-Ru, P.O. Box 487, Chang-Hua City, 500 (TW)

( * ) Notice: Subject to any disclaimer, the term of this patent is extended or adjusted under 35 U.S.C. 154(b) by 0 days.

(21) Appl. No.: 09/985,228

(22) Filed: Nov. 2, 2001

(65) Prior Publication Data

US 2002/0070221 A1 Jun. 13, 2002

(30) Foreign Application Priority Data

Dec. 7, 2000 (TW) ..... 89221231 U

(51) Int. Cl.[7] ..... B65D 25/04

(52) U.S. Cl. ..... 220/522; 220/836; 220/840; 220/4.27; 220/23.6; 206/373

(58) Field of Search ..... 220/522, 836, 220/840, 524, 507, 555, 4.01, 4.21, 4.22, 4.24, 4.27, 23.4, 23.6, 23.8, 23.83, 23.86; 206/373, 372, 745, 747, 748, 756, 770; 190/102, 107, 108, 109, 110, 111, 117

(56) References Cited

U.S. PATENT DOCUMENTS 4,998,616 A * 3/1991 Hillinger ..... 190/17
5,676,240 A * 10/1997 Cziraky et al. ..... 206/1.7

* cited by examiner

*Primary Examiner*—Stephen Castellano

(57) ABSTRACT

A foldable tool kit comprises two abutted elongate first compartments, two abutted second compartments on either side of the first compartment, each second compartment being smaller than the first compartment, and a plurality of hinges each for coupling each of the second compartments to the first compartment or two of the second compartments on the same side. The stored tools are protected from being lost due to the provisions of engaged positioning pegs and holes on the second compartments as well as prevented from mixing due to the provision of covers on the second compartments while carrying.

6 Claims, 6 Drawing Sheets

FOLDABLE TOOL KIT

FIELD OF THE INVENTION

The present invention relates to tool kit and more particularly to a foldable tool kit with improved characteristics.

BACKGROUND OF THE INVENTION

A variety of tool kits are commercially available now. All of them are endeavored to provide as much receiving space as possible. Also, most of such portable tool kits are integrally formed for reducing manufacturing cost. However, the usually compartmented tool kits are not well designed. Thus, it is often found that no suitable compartment is available for a tool. Further, tools tend to mix while storing in the kit. Furthermore, some compartments may be left unused for a long time if the corresponding suitable tools are lost. Most importantly, foldable tool kits are rarely commercially available. Thus, it is desirable to provide an improved foldable tool kit to fulfil such needs.

SUMMARY OF THE INVENTION

It is an object of the present invention to provide a foldable tool kit comprising two abutted elongate first compartments, two abutted second compartments on either side of the first compartment, each second compartment being smaller than the first compartment, and a plurality of hinges each for coupling each of the second compartments to the first compartment or two of the second compartments on the same side. The stored tools are protected from being lost due to the provisions of engaged positioning pegs and holes on the second compartments as well as prevented from mixing due to the provision of covers on the second compartments while carrying.

The above and other objects, features and advantages of the present invention will become apparent from the following detailed description taken with the accompanying drawings.

DETAILED DESCRIPTION OF THE PREFERRED EMBODIMENTS

Figure 1:
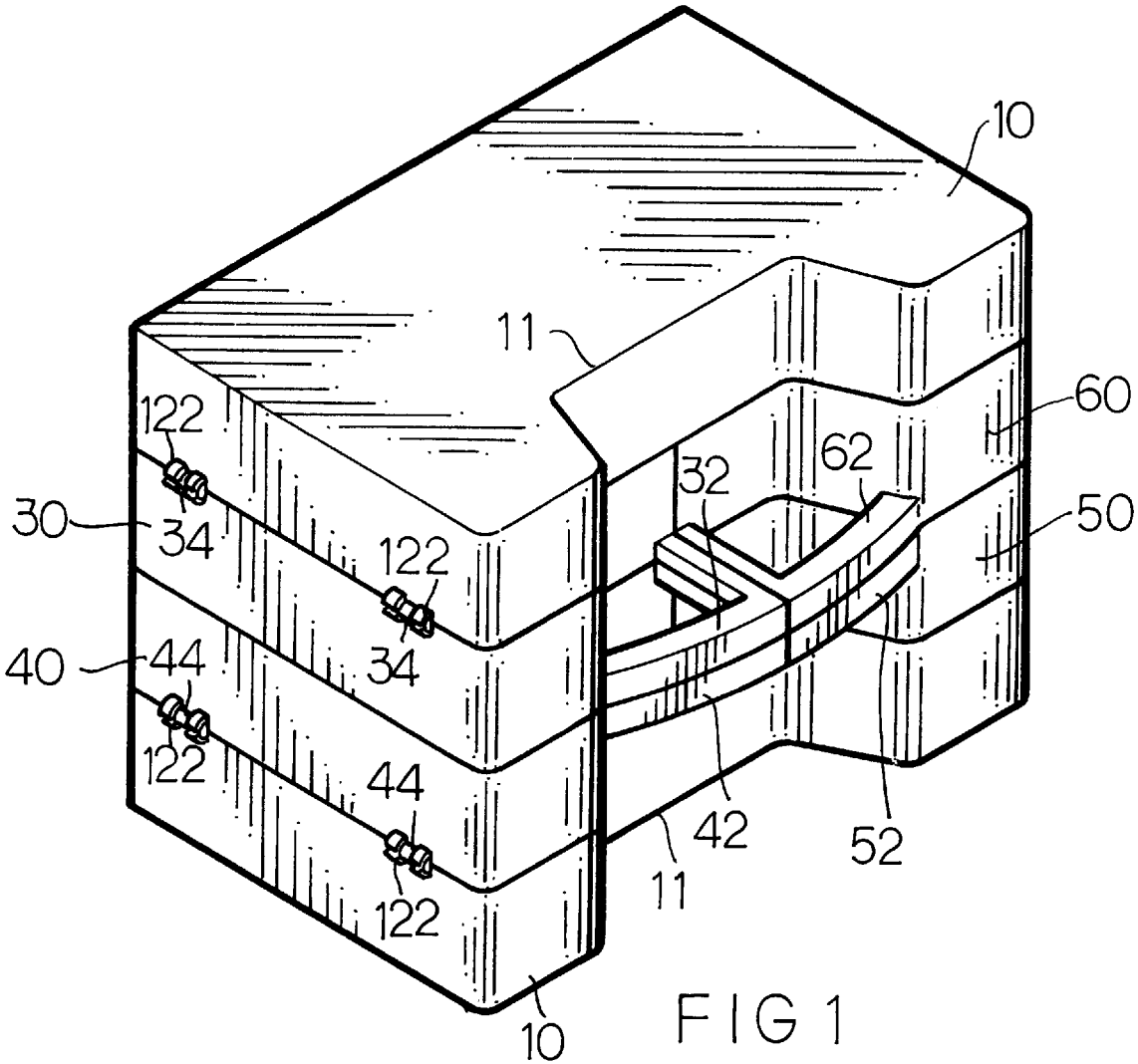
FIG. 1 is a perspective view of a foldable tool kit according to the invention.

Referring to FIGS. 2 through 7, there is shown a foldable tool kit constructed in accordance with the invention. In the extended form, the tool kit comprises two abutted elongate first compartments 10 and two smaller second compartments 30 and 40 (or 50 and 60) on either side of the first compartment 10 in which both second compartments 40 and 50 are hinged to one first compartment 10, both second compartments 30 and 60 are hinged to the other first compartment 10, second compartments 30 and 40 are hinged together, and second compartments 50 and 60 are hinged together. It is designed that large tools such as hammers, pliers, wrenches, etc. are stored in first compartments 10, while small tools such as nails, screws, etc. are stored in further compartmented second compartments 30 through 60 (e.g., several sub-compartments 35 in second compartment 30).

Figure 5:
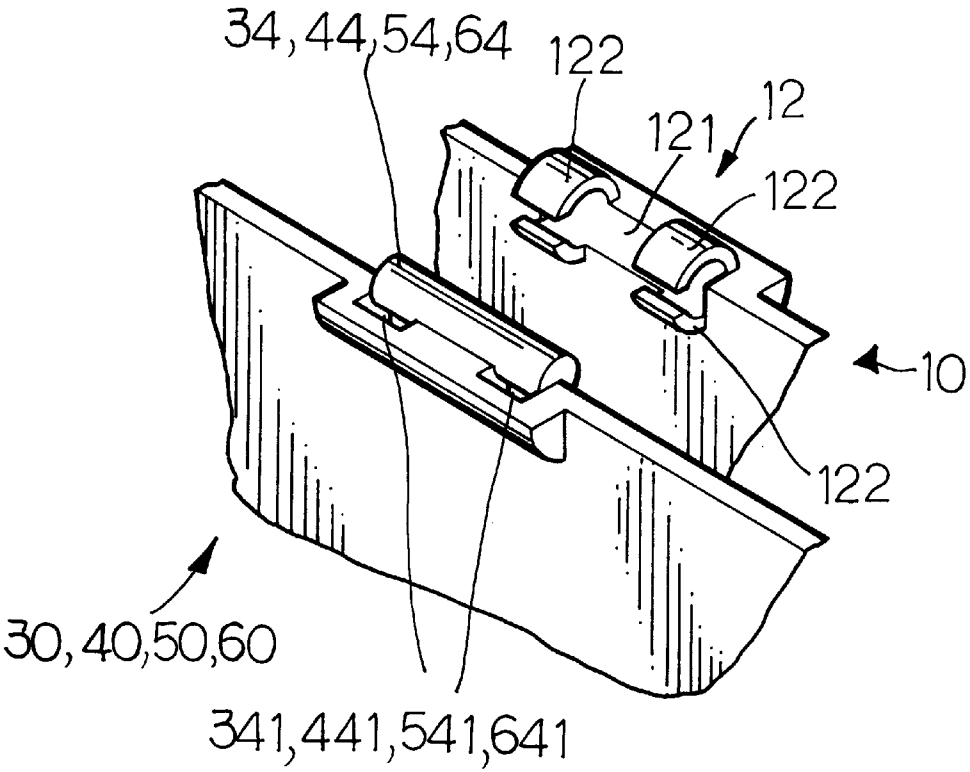
FIG. 5 is an enlarged fragmentary view of a side hinge shown in FIG. 4.
Figure 7:
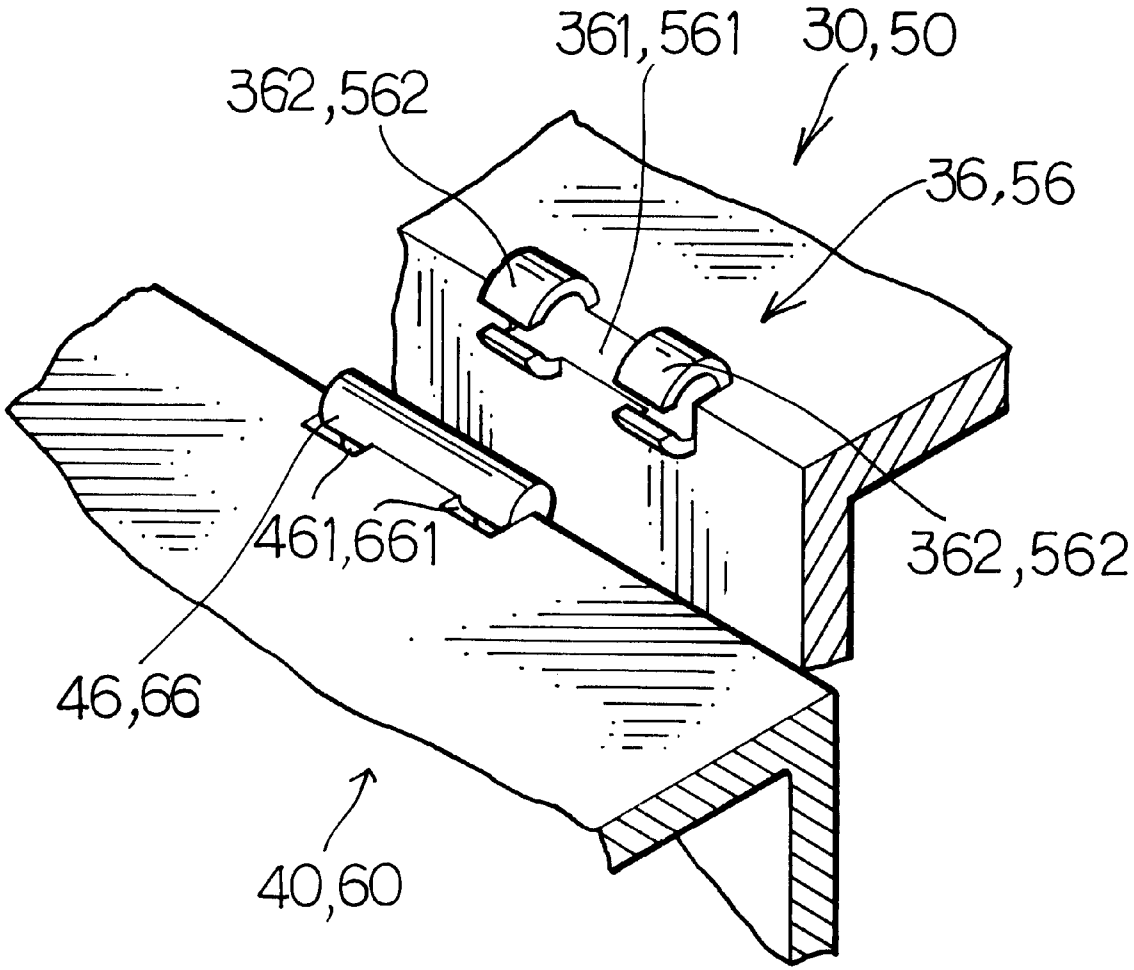
FIG. 7 is an enlarged exploded perspective view of a bottom hinge shown in FIG. 2.

The first compartment 10 comprises a recess 11 on the external edge and a pair of hinges 12 at either side. Hinge 12 is integrally formed and is comprised of a transverse groove 121 and two end cylindrical clips 122. Each of second compartments 30 through 60 has an inwardly recessed comer 31, 41, 51, and 61 respectively. Each of second compartments 30 through 60 has an L-shaped member 32, 42, 52, and 62 respectively. Each of handles 32 and 62 has positioning pegs 33 and 63 respectively. Each of handles 42 and 52 has holes 43 and 53 for receiving positioning pegs 33 and 63 respectively (see FIGS. 2 and 6) when second compartments 30 and 60 are swung to cover on second compartments 40 and 50 respectively. Each of second compartments 30 through 60 has a pair of cylindrical mating hinge portions 34, 44, 54, and 64 respectively. The pair of mating hinge portions 34, 44, 54, or 64 is configured to be corresponding to the pair of hinge portions 12. As shown in FIG. 5, each mating hinge portions 34, 44, 54, and 64 has two end arcuate slots 341, 441, 541, and 641. Hence, each mating hinge 34, 44, 54, and 64 may be pivotably secured to the corresponding hinge portion 12 wherein for example, mating hinge portion 34 is clung onto the transverse groove 121 by sufficiently expanding the gaps of the clips 122 and one ends of the clips 122 are received in the arcuate slots 341. As shown in FIG. 7, a hinge 36 (or 56) of second compartment 30 (or 60) is at the bottom when the tool kit is extended and is also comprised of a transverse groove 361 (or 561) and two end cylindrical clips 362 (or 562). A cylindrical mating hinge 46 (or 66) is formed corresponding to hinge 36 (or 56). Mating hinge 46 (or 66) has two end arcuate slots 461 (or 661). Hence, mating hinges 46 and 66 may be pivotably secured to the corresponding hinges 36 and 56 respectively. Similarly, for example, mating hinge 46 is clung onto the transverse groove 361 by sufficiently expanding the gaps of the clips 362 and one ends of the clips 362 are received in the arcuate slots 461. A hinged cover 70 is provided on each of second compartments 30 through 60. Cover 70 has two pins 71 on two corners each corresponding to a hole 47 on the comer of second compartment 30, 40, 50, or 60. Hence, above hinge mechanism of cover 70 is carried out. Cover 70 further comprises a recess 72 for ease of pulling cover 70 up and a positioning peg 73 at the underside of recess 72. Each of second compartments 30 through 60 includes an internal projection having a hole 38, 48, 58, and 68 respectively for receiving the corresponding positioning peg 73 when cover 70 is swung to enclose second compartments 30, 40, 50, or 60.

Figure 2:
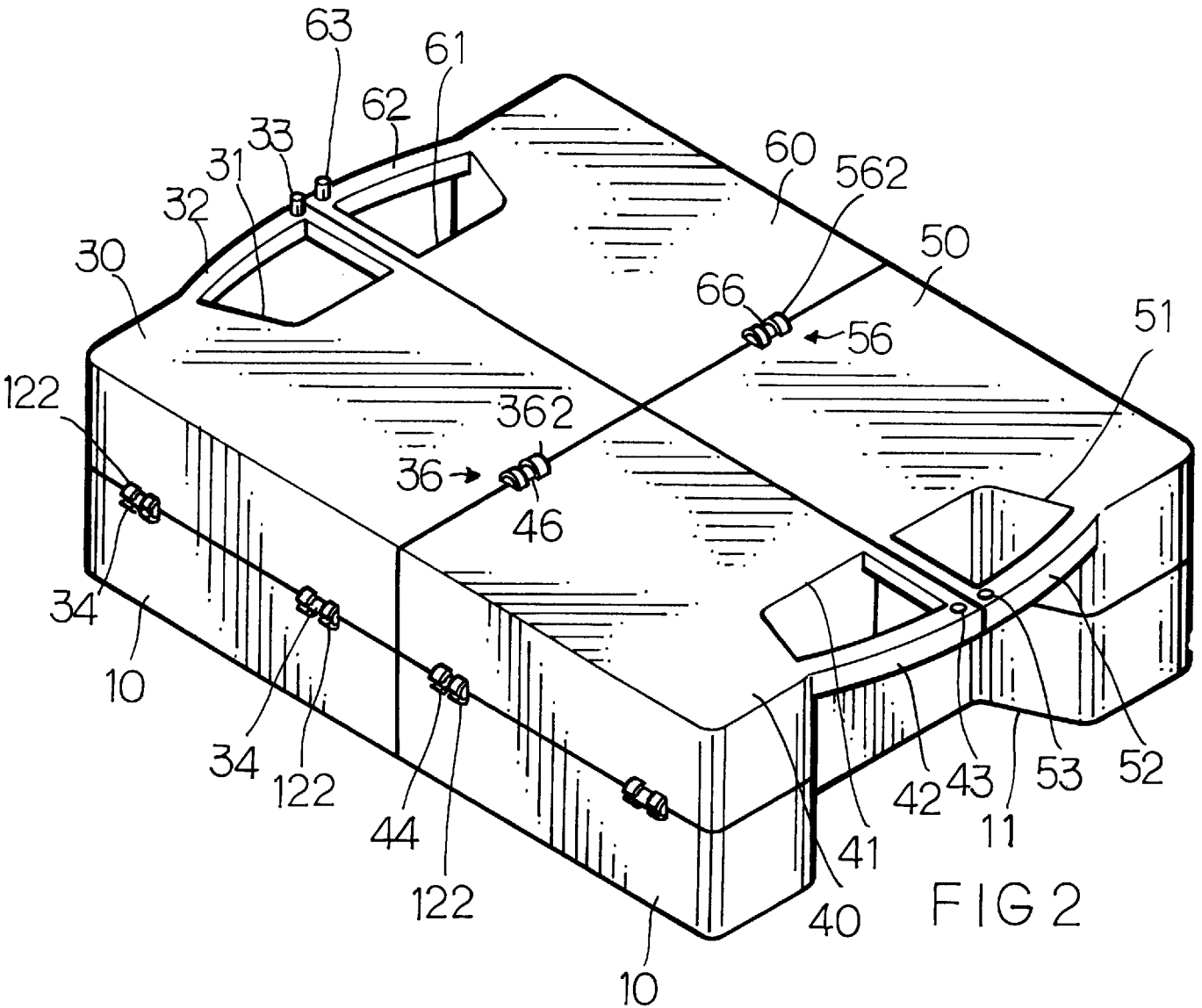
FIG. 2 is a perspective view of a partially extended FIG. 1 tool kit.
Figure 3:
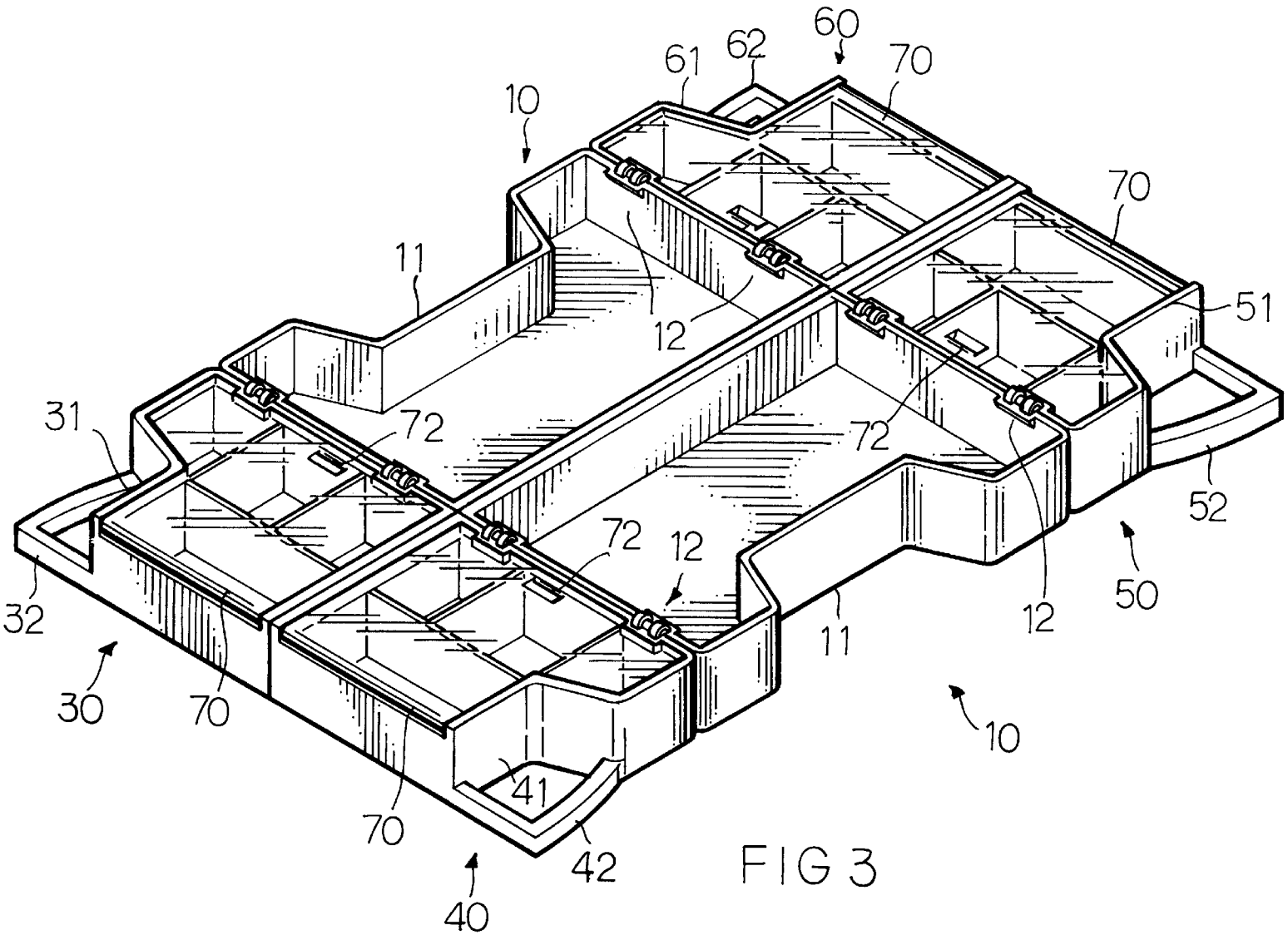
FIG. 3 is a perspective view of the fully extended FIG. 1 tool kit.
Figure 4:
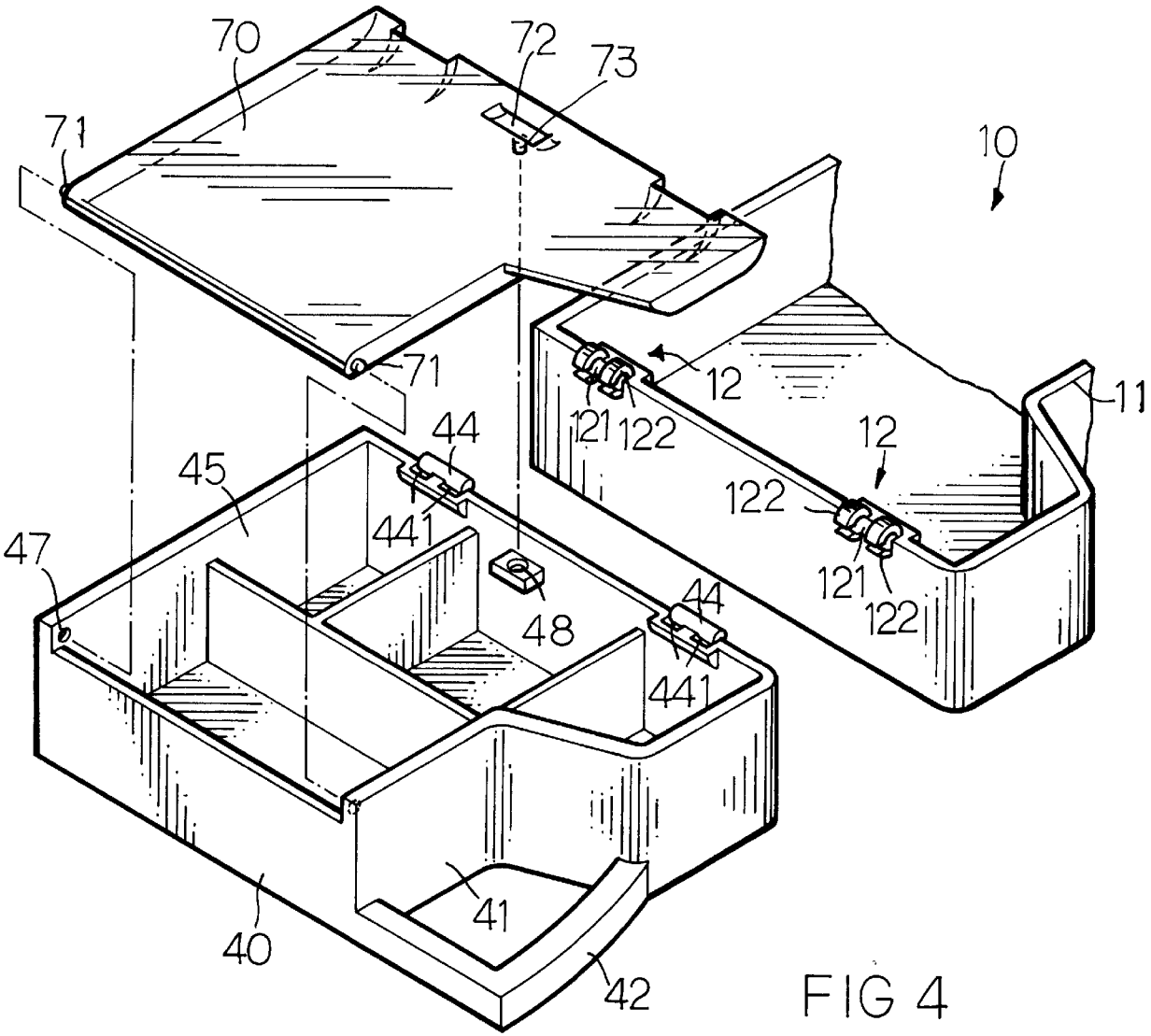
FIG. 4 is an exploded perspective view of a portion of the FIG. 1 tool kit.
Figure 6:
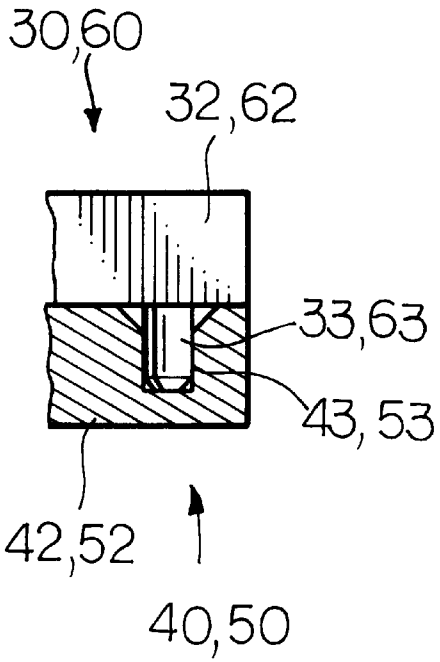
FIG. 6 is cross-sectional view of a portion of the FIG. 1 tool kit.

It is apparent that those skilled in the art may assemble above hinges and compartments together to form a complete tool kit. Referring to FIGS. 1 to 3, there are shown a folded, partially extended, and fully extended tool kit of the invention respectively. It is seen that various compartments are provided within the internal space for storing various tools. Further, an ergonomic handle consisting of four L-shaped members 32, 42, 52, and 62 is adapted to ease of carrying. Furthermore, the stored tools are well protected from being lost due to the provision of the engaged positioning pegs 33 and 63 and holes 43 and 53 as well as prevented from mixing due to the provision of covers 70 on the second compartments 30 through 60 while carrying.

While the invention has been described by means of specific embodiments, numerous modifications and variations could be made thereto by those skilled in the art without departing from the scope and spirit of the invention set forth in the claims.

What is claimed is:

1. A foldable tool kit comprising:

two first compartments which are elongate and adjacent to one another;

four second compartments two of which are adjacent to one another and are located to one first sides of said two first compartments, and the other two of which are also adjacent to one another and are located on second sides of said two first compartment; said second sides are opposite to a corresponding one of said first sides; each second compartment being smaller than each of said first compartments;

a plurality of hinge means each for coupling each of said second compartments to a corresponding one of said first compartments; and each of said second compartments further comprises a first aperture on either comer, an internal projection having a second aperture, and a cover including a pin on either side pivotably received in said first aperture, a recess on said top, and a positioning stud at an underside received in said second aperture when said cover is swung to enclose said second compartment.

2. The foldable tool kit of claim 1, wherein each of said first compartments comprises a recess on said external edge.

3. The foldable tool kit of claim 1, wherein each of said hinge means comprises a transverse groove, a cylindrical clip at either end of said transverse groove, a cylindrical mating portion of the hinge, and an arcuate slot at either end of said mating hinge portion so that said mating hinge portion is clung onto said transverse groove one ends of said clips are received in said slots.

4. The foldable tool kit of claim 1, wherein each of said second compartments comprises an inwardly recessed comer and an L-shaped member.

5. The foldable tool kit of claim 4, wherein said L-shaped members are served as a handle when said tool kit is folded.

6. The foldable tool kit of claim 1, wherein each of said second compartments is divided into a plurality of sub-compartments.

* * * * *